US011744767B2

(12) United States Patent
De Haas et al.

(10) Patent No.: US 11,744,767 B2
(45) Date of Patent: Sep. 5, 2023

(54) EXFOLIATING HEAD WITH ROLLING ELEMENTS

(71) Applicant: KONINKLIJKE PHILIPS N.V., Eindhoven (NL)

(72) Inventors: Rogier Enrico De Haas, Hilversum (NL); Maurits Koenen, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 94 days.

(21) Appl. No.: 17/379,015

(22) Filed: Jul. 19, 2021

(65) Prior Publication Data

US 2021/0338519 A1 Nov. 4, 2021

Related U.S. Application Data

(63) Continuation of application No. 16/305,194, filed as application No. PCT/EP2017/062321 on May 23, 2017, now Pat. No. 11,096,858.

(30) Foreign Application Priority Data

May 31, 2016 (EP) ..... 16172197

(51) Int. Cl.
*A61H 7/00* (2006.01)
*A61H 15/00* (2006.01)

(52) U.S. Cl.
CPC ..... *A61H 7/005* (2013.01); *A61H 15/0085* (2013.01); *A61H 2015/0014* (2013.01);
(Continued)

(58) Field of Classification Search
CPC .... A61H 7/002–005; A61H 2015/0007–0021;
(Continued)

(56) References Cited

U.S. PATENT DOCUMENTS 2,628,611 A * 2/1953 Wagner ..... A61H 15/0092 601/114
5,103,560 A * 4/1992 Podolsky ..... A46B 15/0075 30/535

(Continued)

FOREIGN PATENT DOCUMENTS

CN 2657652 Y 11/2004
CN 2689929 Y 4/2005

(Continued)

OTHER PUBLICATIONS

Roller Ball Brush Head Instructions, Skinn, Dimitri James, Accessed Jul. 15, 2021.

(Continued)

*Primary Examiner* — Valerie L Woodward

(57) ABSTRACT

A skin treatment head includes treatment head surface; multiple bristles extending from the treatment head surface and defining a virtual edge face circumferentially surrounding the bristles and a virtual top face defining a first height of the bristles; and one or more rotatable elements extending from the treatment head surface and having a second height lower than the first height, such that in order to apply a tangential force to rotate the rotatable elements, the skin treatment head is tilted relative to a skin surface.

20 Claims, 4 Drawing Sheets

(52) U.S. Cl.
CPC ..... *A61H 2015/0042* (2013.01); *A61H 2201/1215* (2013.01); *A61H 2201/1671* (2013.01)

(58) Field of Classification Search
CPC ..... A61H 2015/0042–005; A61H 2015/0064; A61H 15/0078; A61H 15/0085; A61H 15/0092; A61H 15/02; A46B 9/023; A46B 13/008; A46B 13/02; A46B 13/026–06; A46B 15/0075; A46B 2200/102; A46B 2200/1033; A46B 2200/1046; A45D 25/46; A45D 27/04; A45D 27/06; A45D 34/041; A45D 34/042–048
See application file for complete search history.

(56) References Cited

U.S. PATENT DOCUMENTS 5,133,130 A * 7/1992 Podolsky ..... A46B 11/0055 30/535
5,662,593 A * 9/1997 Tillman ..... A61H 15/0085 601/17
5,725,483 A * 3/1998 Podolsky ..... A46B 13/04 601/87
6,098,635 A 8/2000 Marino
6,102,875 A * 8/2000 Jones ..... A61H 15/0085 601/19
11,096,858 B2 * 8/2021 De Haas ..... A61H 7/005
2005/0015030 A1 * 1/2005 Bousfield ..... A61N 1/40 601/129
2006/0058714 A1 3/2006 Rhoades
2006/0135319 A1 * 6/2006 Berman ..... A46B 13/02 482/11
2015/0141884 A1 * 5/2015 Thiebaut ..... A45D 40/262 601/154
2015/0182078 A1 7/2015 Miller
2015/0202114 A1 7/2015 Pardoel
2016/0184175 A1 * 6/2016 Caberlotto ..... A61H 7/005 601/114

FOREIGN PATENT DOCUMENTS

CN 2726593 Y 9/2005
CN 100484494 C 5/2009
CN 204813632 U 12/2015
GB 196951 A 4/1923
WO 1987000425 A1 1/1987

OTHER PUBLICATIONS

International Search Report and Written Opinion, International Application No. PCT/EP2017/062321, dated Jul. 25, 2017.

* cited by examiner

EXFOLIATING HEAD WITH ROLLING ELEMENTS

CROSS-REFERENCE TO PRIOR APPLICATIONS

This application is a Continuation application of U.S. National Phase application under 35 U.S.C. § 371, Ser. No. 16/305,194, filed on Nov. 28, 2018, which claims the benefit of International Application Serial No. PCT/EP2017/062321, filed on May 23, 2017, which claims the benefit of European Application No. 16172197.2, filed on May 31, 2016. These applications are hereby incorporated by reference herein.

FIELD OF THE INVENTION

The invention relates to a device for treating part of a skin. The invention further relates to a skin treatment head for use in such device, as well as to a method of treating a part of the skin.

BACKGROUND OF THE INVENTION

Brushes for treating the skin are known in the art. US2006/0058714, for instance, describes an apparatus including a handle capable of manipulation by a human hand, and one or more head portions to mate to various types of treatment attachments, which may be moved over an area of skin and/or body part by a motion generator moving the head portions, and/or by a user manipulating the handle. Various suitable attachments include applicator attachments having abrasive surfaces, oxygenating attachments having pores through which oxygen may travel, brush attachments for cleaning and polishing, thermal attachments for heating and cooling, and light radiating attachments. The motion generator may move the attachments by vibrating, spinning, oscillating, or propagating sonic waves through the head portions. Thus, attachments may be attached and removed from the head portions to treating skin and/or body parts by abrasion, cleaning, polishing, lighting, or oxygenation. Moreover, during treatment with an abrasive composition, a cleaning solution, and/or a polishing solution may be applied to the skin and/or body part.

U.S. Pat. No. 6,098,635 describes a rotating hair brush having several dividers between some of the rows of bristles. The dividers prevent hair from being tangled in the bristles as the brush rotates. The dividers also help smooth the hair and absorb and transfer back to the hair heat from a blow dryer. The dividers may be of many different shapes and may extend longitudinally or curve along the brush. Structure allows the brush to be removed from the handle that contains the motor and battery powering the brush. The brush also may have a guide covering part of the bristles.

US2015/182078 describes a cleansing workpiece suitable for use with a personal care appliance. The cleansing workpiece includes a cleanser and a cleansing component, such as a number of tufts each having a plurality of bristles. In use, the cleansing workpiece can be rotated, reciprocated, oscillated, etc., over a subject's skin in order for the cleansing workpiece to dispense or apply a quantity of the cleanser onto the subject's skin and/or for the cleansing component to clean, massage, and/or exfoliate a subject's skin with the aid of dispensed cleanser. The cleanser may be continuously applied to the subject's skin as the cleansing component.

GB196951 describes a massage rubber comprises a non-rotatable reservoir adapted to be supplied with water or other liquid and carrying a number of balls or rollers and a perforated dome-shaped receptacle containing a medical preparation, bath salts, soft soap, skin food or similar substance, the arrangement being such that as the balls or rollers bear on the flesh, valves are opened allowing liquid to flow through lateral perforations, while liquid also flows through the receptacle and carries the substance therein into contact with the flesh, to be rubbed in or applied by the traverse of the rollers or the balls. The valves, which may be closed normally by a spring or by force of gravity, are seated in rings screwed into openings in the reservoir, the openings being closed by perforated discs. The receptacle is adapted to be screwed to a perforated nozzle at the centre of the reservoir. The handle may be connected by a flexible pipe to a hot water tap or to a portable water-heater. The handle may be insulated and connected to a terminal of an electric circuit to electrify the liquid.

SUMMARY OF THE INVENTION

Brush movement known from prior art body care devices, such as facial cleansing devices, may typically comprise a continuous rotation or an oscillating rotation (very small angles). Especially, brushes with continuous rotation have a disadvantage that whenever the brush is placed on the skin in a tilted way (i.e., for instance wherein the bristles are not arranged perpendicular to the skin surface), the brush may start pulling (and moving) (sideways) in a certain direction. This is caused by the friction force from a small area of bristles (also referred to as "hairs") at the outside diameter of the brush that is carrying all the brush force and successively moves in a certain direction. This effect may be solved by making the bristles located at the outside diameter of the brush less stiff (compared to bristles located more remote of the outside diameter/more close to the center) or by changing the movement principle from a continuous rotation to an oscillating rotation. However, these solutions may result in a reduced freedom to operate. Moreover, these solution may not result in providing the optimum brush position, especially wherein the bristles are arranged perpendicular to the skin surface. Further, bristles comprising a lower stiffness may provide a less efficient cleansing and/or exfoliating effect of the device.

Hence, it is an aspect of the invention to provide an alternative body care device, which especially further at least partly obviates one or more of the above-described drawbacks. It is yet a further aspect of the invention to provide a method of treating (a part of) a skin using said body care device. It is also an aspect of the invention to provide an alternative skin treatment head, especially for use with the body care device described herein. In yet a further aspect, the invention provides a kit of parts comprising a treatment head and one or more of at least a further treatment head and a body care device, especially the treatment head(s) and/or the body care device as described herein.

In a first aspect, the invention provides a body care device ("device") for treating a skin, the body care device comprising a housing and a skin treatment head ("head") associated with the housing, wherein the housing further comprises an actuator configured to (at least partly) rotate the skin treatment head about an axis (A) ("head rotation axis"), wherein the skin treatment head comprises a plurality of bristles defining a virtual edge face ("edge face") circumferentially surrounding the plurality of bristles and defining a virtual top face ("top face") defining a first height (h1) of the bristles relative to a skin treatment head surface of the skin treatment head, wherein the skin treatment head further comprises a plurality of rotatable elements, wherein especially each rotatable element is configured to rotate when a force in a tangential direction is applied to a rotatable element surface of the rotatable element, wherein in specific embodiments the rotatable element surfaces are configured lower than the top face (i.e., wherein the rotatable element surfaces relative to the virtual top face are configured less remote from the skin treatment head surface). Especially, the rotatable elements have (rotatable element) diameters ("diameters") (d1). In embodiments, (i) the rotatable element surfaces at least partly extend beyond the edge face or (ii) in other embodiments the rotatable element surfaces do not extend beyond the edge face and are configured (at a side of the edge face facing towards the plurality of bristles) at a (minimal) distance (d2) from the edge face being selected from the range of 0-200%, especially 0-100% of the diameters (d1), such as in the range of 0-50% of the diameters (d1).

The term "plurality of rotatable elements" may in embodiments refer to a number of rotatable elements being substantially the same, and may in other embodiments refer to a number of rotatable elements comprising one or more rotatable elements that differ from other rotatable elements (of the plurality of rotatable elements). The term "diameters" thus may refer to substantially the same diameters, whereas in other embodiments the term may refer to different diameters (for different rotatable elements). Especially herein the rotatable elements (and thus the diameters) are substantially alike.

Such a body care device may prevent skin damage, especially by limiting the brush force acting on the skin. With such body care device, a user may be provided by a tactile feedback when the optimum brush position is not maintained, especially when the housing and the head (brush) are tilted. Whenever the brush (bristles) is (are) deformed because of local or general overloading by the user, the rotatable elements that are configured (just) underneath the virtual top face (of the brush) may take over (and dissipate) the force/energy. Especially, the brush may start vibrating and continue in a jerky movement, especially 'bumping' at the skin of the user. Such a tactile feedback may notify the user to change the position of the treatment head. Such body care device may especially not pull or move (aside) in a certain direction, especially when (continuously) rotating. Especially such body care device may comprise a great degree of freedom allowing a continuous rotation as well as an oscillating rotation, especially indicating the user how to maintain an optimal position of the head (with respect to the skin).

The body care device may be configured as facial cleaning (also indicated as "cleansing") device. Hence, especially the body care device may be a facial cleaning device. Further, the body care device may be configured as an exfoliating device. However, the body care device may also be configured for other skin cleaning applications. For different parts of the skin, optionally a plurality of treatment heads, optionally comprising different changeable parts, may be provided, each especially devoted to a specific part of the skin. Alternatively or additionally, the body care device may include a control system, configured to control the actuator and to offer different treatment schemes, e.g. with different settings like rotational speed, oscillation frequency, axial vibration frequency (see also below), etc., etc.

Especially, the body care device may be a handheld device. However, the body care device may also be integrated in a robot configured for assisting or treating people, like elderly people or people in a hospital, etc. The device is especially configured for treating the skin of a human (including infants). Hence, also different treatment heads, and/or treatment head configurations and/or different treatment schemes may be used for different types of people, e.g. dependent upon the age and/or the type of skin. Hence, the invention also provides a kit of parts, including (housing of a) a body care device and one or more treatment heads, especially a plurality of different treatment heads (with the body care device especially configured for use with detachable treatment heads). Yet further, the invention also provides a kit of parts, including a housing of a body care device as defined herein, and one or more skin treatment heads as defined herein, for use with the housing of the body care device (as defined herein).

Essentially, the body care device comprises a housing and a skin treatment head associated with the housing. The skin treatment head is in general associated with the housing via an axis or "shaft" which is functionally coupled with the actuator. The treatment head may be associated with the housing, such as with the shaft, in a permanent way or in a releasable way. In the latter option, the treatment head may be replaced when considered desirable, e.g. because of hygienic reasons, when treating a different part of the skin, or when the treatment head loses functionality (e.g. due to erosion). Hence, especially the skin treatment head is detachable associated to the housing. For instance, snap-on snap-off means, or a screw-thread connection may be applied, though other options may also be possible.

As indicated above, the housing further comprises an actuator configured to rotate the skin treatment head about an (head rotation) axis (A). Especially, the actuator is configured to (at least partly) rotate the treatment head (during use of the device). Especially, the rotations may be full rotations (i.e. rotation angle 360°). However, in yet other embodiments the rotations may be part rotations, and the treatment head may rotate about the (head rotation) axis A in an oscillatory way. In such embodiments, the rotation angle (about the head rotation axis) is especially at least 5°, such as at least 10°, such as at least 30°. In further embodiments, the rotation angle is at most 30°, such as in the range of 5-30°, especially in the range of 15-30°. Hence, the treatment head is especially rotatably associated with the housing. The treatment head can be rotated relative to the housing by the actuator. The phrase "configured to (at least partly) rotate the skin treatment head about an axis" may thus in embodiments refer to full rotations, "herein also indicated as continuous rotation" ("configured to rotate the skin treatment head about an axis"), i.e. rotation angles (about the head rotation axis) of 360°, and may in other embodiments refer to part rotations, i.e. oscillations over a rotation angle of e.g. 5-30° ("configured to at least partly rotate the skin treatment head about an axis"). In both types of embodiments, the treatment head rotates (at least partly) about an axis (of rotation), especially the head rotation axis. Hence, the actuator may be configured to rotate (rotation angles of 360°) the skin treatment head about an axis and/or the actuator may be configured to oscillate (rotation angles<360°, especially <<360°) the skin treatment head about an axis. In embodiments, the actuator is configured to fully rotate the skin treatment head about the (head rotation) axis. Hence, during use, the treatment head may substantially continuously rotate.

In yet other embodiments, the treatment head may include different portions that may rotate with different speeds and/or different angles. Hence, the actuator may also be configured to rotate different portions of the treatment head with different rotation conditions especially selected from the range of rotation speed (including direction) and rotation angle.

However, the actuator may also be used to apply other movements to the treatment head, such as a vibrational movement, which may especially be parallel to the rotation axis. Hence, in embodiments the actuator is further configured to vibrate the skin treatment head parallel to the (head rotation) axis (A). Alternatively or additionally, the actuator may be configured to vibrate the skin treatment head perpendicular to the (head rotation) axis (A). The body care device may be configured to move the skin treatment head rotationally as well as vibrationally (in different directions), especially at the same time. The term "actuator" may also refer to a plurality of actuators. Different actuators may be configured for different movements. A non-limiting example of a similar system is described in WO2014009177A1, which is herein incorporated by reference.

Useful rotational speeds for the rotation of the treatment head (about the axis of rotation, herein also indicated as "head rotational axis" or "head rotation axis") may be selected from the range of up to 500 rpm, such as in the range of 50-500 rpm, like especially in the range of 120-450 rpm.

Useful frequencies for the oscillation may be selected from the range of up to 350 Hz, like in the range of 60-300 Hz, especially in the range of 90-160 Hz.

A displacement (parallel and/or perpendicular to the axis), in the case of a vibration movement, relative to a rest position may e.g. be selected from the range of up to 0.01-2 mm (in a single direction), and especially about 0.05-1 mm peak-to-peak. Frequencies for the vibration may be selected from the range of up to 350 Hz, such as selected from the range of 20-350 Hz, such as in the range of 50-300 Hz. Especially, embodiments of the body care device may be configured to move the skin treatment head rotationally and optionally, especially at the same time, vibrationally (optionally in different directions).

The skin treatment head (or "brush") comprises a plurality of bristles. The bristles may be configured in tufts, such as at least 10 tufts, like in the range of 10-500 tufts, like in the range of 20-200 tufts. The head may comprise e.g. in the range of 10-10,000 bristles, such as at least 100 bristles. A tuft may e.g. include 2-50 bristles, like 5-25 bristles.

The bristles may be arranged perpendicular to the skin treatment head surface. The (longitudinal axis of) bristles may also form an angle (less than 90°) with the said surface. Hence, in embodiments, a longitudinal axis of at least one of the bristles of the plurality forms an angle≠90° with the skin treatment head. In further embodiments, at least one bristle of the plurality of bristles is arranged perpendicular to the skin treatment head surface. In yet other embodiments, all bristles are arranged perpendicular to the skin treatment head surface.

Independently of the configuration of a bristles (whether arranged perpendicular to the treatment head surface or not), a bristle height (of the bristle) may be defined by a longest distance along a line perpendicular to the skin treatment head surface between the bristle and the skin treatment head surface. In embodiments, each of the bristles of the plurality of bristles comprises the same bristle height. In other embodiments different bristles of the plurality of bristles comprise different bristle heights. The skin treatment head may comprise one or more regions, each region comprising at least one bristle, especially a plurality of bristles (such as at least 10). Especially, each region may comprise only bristles having the same bristle height (or just one bristle with said bristle height). In embodiments, a (first) bristle height of bristles in a (first) region may differ from a (second) bristle height in a (second) region. For instance, the second region may circumferentially enclose the first region.

Especially, in embodiments each of the bristles of the plurality of the bristles comprises the same bristly height.

Yet in other embodiments, the plurality of bristles may comprise mutually different bristle heights, such as with heights gradually changing over the skin treatment head surface (see below).

The arrangement of the bristles may be symmetric or may be non-symmetric. Substantially any arbitrary arrangement may be chosen, though specific embodiments are further described herein, which in general have one or more types of symmetry.

In embodiments, the skin treatment head comprises (exactly) one region.

In other embodiments, the skin treatment head comprises 2-3 regions. Yet in further embodiments, the skin treatment head comprises 2-6 regions.

In yet other embodiments, the bristle heights vary smoothly over the surface area of the skin treatment head. Hence, the skin treatment head may comprises at least 10 regions, such as in the range of 10-50, or at least 100. The regions may be configured in a plurality of possible configurations. In embodiments, for instance a second region circumferentially surrounds a first region (see also above), and especially a third region may circumferentially surround the second region, etc., etc. Especially, there may be gradual decrease or increase in bristle height from the center (of the treatment head (surface)) to the edge of the treatment head.

In specific embodiments, the bristles have a bristle height relative to said treatment head surface especially selected from the range of 4-30 mm, even more especially 8-20 mm. Further, in embodiments the bristles have especially a bristle thickness selected from the range of 20-300 μm, even more especially 30-150 μm. With such bristles, the desired flexibility and strength may be obtained, desirable by the user. The height of the bristles may vary over the treatment head surface. For instance, the bristle height may be larger at the edge and smaller closer to the center (rotational axis) of the treatment head. Hence, the height of the bristles may vary along the radius from higher to lower or from lower to higher. For instance, the bristles may be configured to provide a curved brush. Especially, the bristles comprise a polyamide, such as PA 612 (known in the art).

The treatment head surface may be substantially flat, i.e. a flat surface, or may have a curved surface, such as a curvature in one dimension (like a cylindrical surface) or a curvature in two dimensions, like a spherical segment. This surface may in embodiments have an area size of in the range of 1-100 $cm^2$, especially 1.5-50 $cm^2$. Further, the treatment head may in embodiments especially have a circular cross-section, with especially the rotational axis intersecting the center of the circular cross-section.

The plurality of bristles (when in a non-stressed state) define a virtual edge face circumferentially surrounding the plurality of bristles. This virtual edge face especially is defined when the bristles are not forced against a surface. The plurality of bristles (in a non-stressed state) may also define a virtual circular tube (hollow cylinder) surrounding the plurality of the bristles, wherein the surface of the tube comprises the virtual edge face.

The plurality of bristles (in said non-stressed state) also define a virtual top face at the side of the plurality of bristles most remote from the treatment head surface. This virtual top face especially is defined when the bristles are not forced against a surface. The virtual top face especially defines the first height of the bristles relative to the skin treatment surface.

Especially, the bristle height and the first height are the same. Herein, the term "first height" may refer to exactly one first height. However, the term "first height" may also relate to more than one first height (of different bristles). Especially different regions may comprise different first heights. In embodiments, the skin treatment head comprises exactly one first height (for all bristles). In yet other embodiments, the skin treatment head comprises more than one first height (for more than one subset of bristles). Likewise, the term "virtual top face" may refer to one or more virtual top face(s). Especially the number of first heights may equal the number of virtual top faces. Especially, the number of regions may be equal to the number of virtual top faces.

The virtual top face may comprise a flat virtual top face, especially if the skin treatment head comprises only one region. In other embodiments, the skin treatment head comprises 2-6 regions and 2-6 virtual top faces. In yet other embodiments, the virtual top face may comprise a curved top face, such as a concave top face or a convex top face. Especially in such embodiment, the number of regions may be at least 10, such as at least 50, especially at least 100 to provide such a curved virtual top face.

In embodiments, the virtual top face may (thus) comprise a flat virtual top face. The bristles may define a (virtual) (hollow) cylinder surface surrounding the plurality of the bristles, wherein the cylinder surface comprises the (virtual) edge face and the (virtual) top face. As indicated above, the virtual edge face and the virtual top face described herein are defined for the body care device in a condition wherein no (external) force is applied to the bristles. In such a condition wherein no force is applied to the bristles, the plurality of bristles may be configured within the volume defined by the edge face and the top face. When the body care device is used (positioned to a surface, especially a skin), however, the plurality of bristles may also partly be located outside said volume, wherein the remainder (of the bristles) is (still) located inside said volume. For instance bristles may deform (bend) because of an external force and intersect the virtual edge face.

The treatment head further comprises a plurality of rotatable elements, especially configured to rotate when a force in a tangential direction is applied to a rotatable element surface of the rotatable element. In embodiments, the treatment head may comprise (only) one rotatable element. In embodiments, a rotatable element comprises a spherical shape. Alternatively or additionally, one or more of the rotatable elements comprises a cylindrical shape. Yet in further embodiments, a rotatable element may comprise a conical shape. When the rotatable element has a conical shape or a cylindrical shape, the axis of rotation of such shape is especially configured perpendicular to the axis of rotation of the treatment head. The rotatable elements of the treatment head may be all alike or a combination of two or more different shapes may be applied. The rotatable element may also be indicated as "roller". The roller may be cylindrically shaped or spherically shaped. The roller may also have a conical shape or another shape having an axis of rotation. When moving over the skin, with the rotatable element in contact with the skin, the rotatable element may rotate.

Especially the rotatable element is configured to rotate when a tangential force is applied to the surface (such as when the head is moved over the skin and the skin comes in contact with the rotatable element). Hence the rotatable element may comprise any arbitrary shape that allows rotation when a tangential force is applied to the surface. Especially, spherical shapes are used as they may be able to rotate in all directions. Especially the rotatable element comprises a spherical shape. Especially, "a (rotatable element) diameter" may refer to a diameter of a spherical shaped rotatable element. Yet in further embodiments "a diameter" may refer to a diameter/width of a cylindrically shaped rotatable element.

The arrangement of the rotatable elements (at the skin treatment head) may be symmetric or may be non-symmetric. Especially the rotatable elements are arranged at the outer radius of the brush (see also below). Especially, the arrangement of the rotatable elements is (rotational) symmetric. In embodiments comprising n rotatable elements, the n rotatable elements may especially be arranged symmetrically around a Cn rotation axis of symmetry (providing a rotational symmetry of order n). As will be understood, rotational symmetry of order n (n-fold rotational symmetry, or discrete rotational symmetry of the nth order), with respect to a particular point or axis implies that rotation of an object by an angle of 360°/n (and 2*360°/n, 3*360°/n, . . . , n*360°/n) does not change the arrangement of the object with respect to that axis or point. In embodiments, the skin treatment head comprises exactly one rotatable element. In other embodiments, the skin treatment head comprises at least 2 rotatable elements. Especially, the device, especially the skin treatment head, comprises at least three rotatable elements, such as 3-25 rotatable elements, especially 3-15 rotatable elements, even more especially 3-10 rotatable elements, such as 3-7 rotatable elements. Yet in other embodiments, the device, especially the treatment head, comprises 7-15 rotatable elements. Especially, the device comprises 3-6 rotatable elements.

The treatment head is configured such that the rotatable element surfaces are positioned at a location between the virtual top face of the skin treatment head (or the adjacent virtual top face if the skin treatment head comprises more than one virtual top faces) and the treatment head surface (especially when the body care device is not forced against a (skin) surface). The term "adjacent virtual top face" refers to the virtual top face configured closest to the respective rotatable element (surface). A second height of a rotatable element may be defined as a longest distance between the (respective) rotatable element (surface) and the treatment head surface measured along a line perpendicular to the treatment head surface. The second height is especially at maximum 99% of the first height (defined by adjacent top face). In embodiments, the second height is in the range of 50%-99% of the first height, especially 60-98% of the first height, such as 60-95% of the first height, like 60-80%. Hence, in embodiments, one or more of said rotatable elements have a second height (h2) relative to the skin treatment head surface, wherein said second height (h2) is in the range of 60-95% of the first height (h1) of the bristles. In embodiments, the difference between the first height and the second height is at least 0.5 mm, such as at least 1 mm. In further embodiments, the difference between the first height and the second height is at maximum 5 mm, such as at maximum 3 mm. In further embodiments said second height (h2) (of the rotatable elements) is in the range of 0.5-3 mm lower (or less) than the first height (h1) (of the bristles).

In embodiments, a part of the rotatable element surfaces is configured at a side of the (virtual) edge face, facing towards the head rotation axis. Another part of the rotatable element surfaces is configured at the side of the edge face facing away from the head rotation axis. Hence, in embodiments, the rotatable element surfaces at least partly extend beyond the virtual edge face.

In other embodiments, the entire rotatable element surface is configured at the side of the edge face facing away from the head rotation axis. Yet, in another embodiment, substantially the (entire) rotatable element surface is configured at the side of the edge face facing towards the head rotation axis. Especially, the rotatable element surface is configured at a (minimal) distance (d2) from (either sides of) the edge face selected from the range of 0-200%, especially 0-100% of the diameters (of the—respective—rotatable elements), such as from 0-50% of the diameters.

Especially, (one or more of the) rotatable elements may extend with a first length beyond (in the direction facing away from the head rotation axis) the edge face, wherein the first length is selected from the range of 1-99% of the (rotatable element) diameters, such as 1-75% of the (rotatable element) diameters, especially 5-75% of the rotatable element diameters, even more especially at least 5%, such as 10% of the rotatable element diameters, and especially at maximum 90%, such as 75%, especially 50% of the diameters. Hence, in an embodiment, one or more of said rotatable elements extend with a first length (l1) beyond the edge face. Especially, the first length (l1) is selected from the range of 5-100%, such as especially 5-50% of the diameter (d1), more especially 10-50%. In other embodiments, the first length is selected equal to or larger than the diameter (of the respective rotatable element), and especially the first length is at maximum 200% of the diameter. In embodiments, the first length may be at least 0.1 mm, especially at least 0.5 mm. The first length may especially be at maximum 10 mm, such as at maximum 7 mm, especially at maximum 5 mm, even more especially 3 mm. In further embodiments, the first length (l1) is selected from the range of 0.5-5 mm.

Especially the term "rotatable elements having diameters" may relate to rotatable elements (being alike) having the same diameters as well as different rotatable elements having different diameters. Especially "the diameter" in the term" wherein the first length (l1) is selected from the range of 5-50% of the diameter (d1)" and the like relates to the diameter of the respective rotatable element extending beyond the edge face.

In embodiments, the (complete) rotatable elements are configured within the virtual edge face.

Especially, with such configuration a part of the rotatable element surfaces may only contact a skin surface when the treatment head is forced to the skin surface and bristles are deformed.

Especially, the rotatable elements may be hosted in a fixture or socket allowing the rotatable elements to rotate in the socket. The rotatable elements move along (rotate) with the treatment head (during operation of the skin treatment head on the skin). Especially, during operating the body care device (the skin treatment head), the rotatable elements may continuously rotate around the head rotation axis if the skin treatment head is continuously rotating about the head rotation axis. Similarly, the rotatable elements may rotate oscillating about the head rotation axis when the skin treatment head is rotating oscillating about the head rotation axis. Beyond that, the rotatable elements may freely rotate in the fixture or socket and are especially for this rotation not actuated by an actuation element. This is the rotation due to a tangential force. Hence, the rotatable elements may rotate independently of the rotation of the skin treatment head.

Especially when the treatment head is not positioned optimally during operation of the body care device, a part of the plurality of bristles may be deformed (because of the force exerted on these bristles) and a rotatable element surface of a rotatable element located near the deformed bristles may contact the skin surface. When contacting the skin surface, a force may be exerted on the surface of the respective rotatable elements because of movement of the skin treatment head relative to the skin (i.e. said rotation of the rotatable elements (around the head rotation axis) and also by a movement of the skin when the body care device is moved). Such force, especially a component of the force in a tangential direction with respect to the rotatable element surface, may successively provide a (further) rotation of the respective rotatable element (especially in said tangential direction). A rotatable element comprising a spherical shape especially my allow rotation of the rotatable element in all different (tangential) directions because of its symmetry around one central point of the spherical shaped rotatable element. A (rotatable element comprising a) cylindrical shape may allow rotation around a central axis of the cylindrical shape. Hence, especially the position of a central axis of the cylindrical shaped rotatable element (with respect to the position of the remainder of the skin treatment head and/or the position of the head rotation axis) may affect the tactile feedback to a user and may affect the amount of energy (resulting from overloading by the user) that can be transposed into rotation of the rotatable element. In embodiments, one or more of said rotatable elements are configured to rotate about a second rotation axis (A2) wherein said second rotation axis (A2) and the (head rotation) axis (A) about which the skin treatment head is configured to at least partly rotate have a mutual angle ($\alpha$) selected from the range of 5-135°. In embodiments, the mutual angle is selected from the range of 5-90°, such as 5-60°, especially 5-45°. In yet other embodiments, the mutual angle is selected from the range of 30-60°.

In embodiments, the skin treatment head comprises one or more rotatable element units, wherein each rotatable element unit comprises a socket for hosting rotatably the rotatable element. The socket may comprise substantially any arbitrary configuration allowing rotation of the rotatable element. Especially the socket may be manufactured in one single piece. In embodiments, the socket comprises (slide) bearing. In further embodiments, a socket comprises a ball socket or a ball house (especially for hosting a spherical rotatable element). Especially a (ball) socket does not need to enclose a rotatable element over the entire radius. It may be advantageous to circumvent the rotatable element over the entire radius, especially having openings in the socket. Such socket may, e.g., comprise fingers (and openings between the fingers). Especially, said fingers are evenly spread over the socket. In embodiments a socket comprises three fingers, especially for hosting a rotatable element having a spherical shape. In other embodiments, a socket may comprise at least two fingers for hosting a rotatable element, especially comprising a cylindrical shape. Yet, in further embodiments a cylindrical shaped rotatable element is held by at least three fingers. The socket may also not include fingers but may be configured to hold a cylindrical or spherical rotatable element in an element having a (substantially) rectangular or (substantially) round opening, having dimension not allowing the rotatable element to escape through the opening but especially allowing close to 50% of the rotatable element surface to protrude from the opening. For instance, a spherical rotatable element may be enclosed by a cavity having a diameter (slightly) larger than the diameter of the spherical rotatable element, and having an opening in the form of a sphere segment, having a circular opening slightly smaller than the diameter (see e.g. FIG. 1). Slightly may e.g. refer to 0.1-5% (of the diameter), such as 0.5-2% (of the diameter), like 0.5-1% (of the diameter), which may provide enough clearance. Values for clearances are also indicated elsewhere herein.

As indicated above, the sockets will especially be configured in a symmetrical configuration, such as with a Cn rotation axis with n here being the number of sockets. Especially, the sockets are configured symmetrically about the axis of rotation. Especially a shortest distance between the axis of rotation and a first socket is substantially equal to a shortest distance between the axis of rotation and any further socket, wherein all sockets (the first socket and all further sockets) are distributed evenly over the treatment head.

Hence, in embodiments, the body care device, especially the skin treatment head, comprises one or more rotatable element units, especially a plurality of rotatable element units, wherein each rotatable element unit comprises a socket with at least three fingers for hosting rotatably the rotatable element. Especially in such embodiment one or more rotatable elements may have a spherical shape. Additionally or alternatively in such embodiments one or more rotatable elements may have a cylindrical shape.

The location of the rotatable element with respect to the plurality of bristles may especially be substantially fixed. Especially, the treatment head is configured to prevent a substantial translational movement of the rotatable element(s) with respect to the head rotation axis, especially in a direction parallel and in a direction perpendicular to the axis. Herein the term "substantial translation with respect to the head rotation axis" relates to a translation movement with respect to a location at the head rotation axis positioned most closely to the skin treatment head surface, especially a center of the skin treatment head surface. Especially, the treatment head is configured to prevent a substantial translational movement of the rotatable element(s) with respect to the skin treatment head surface. Especially, the treatment head comprises a stiff treatment head, wherein (only) the bristles are configured flexible. Especially, a position of the rotatable elements relative to the treatment head surface is substantially fixed. In embodiments, the rotatable elements have a translational freedom in a direction parallel and/or a direction perpendicular to the (head rotation) axis of at maximum 20% of the diameter (of the rotatable elements), such as at maximum 15% of the diameter, especially at maximum 10% of the diameter, or even at maximum 5% of the diameter. In further embodiments, the rotatable elements have said translational freedom of substantially 0% of the diameter. Especially the rotatable elements are configured to rotate and substantially not to translate with respect to the (head rotation) axis. Such a configuration may especially provide the desired tactile feedback when the optimum brush position is not maintained during operating the skin treatment head. Such a configuration may also substantially prevent a skin from damaging, especially because it transposes a maximum of the force or energy caused by overloading by the user into rotation energy of the rotatable elements. Hence, in embodiments, the rotatable elements have a translational freedom in one or more of (i) a direction parallel and (ii) in a direction perpendicular to the (head rotation) axis (A) about which the skin treatment head is configured to at least partly rotate selected from the range of 0-20% of the diameter (d1).

Especially, the rotatable elements and the sockets do not allow deformation. Especially the sockets are configured stiff. Of course, the rotatable element(s) must be able to rotate. As will be understood by the skilled person, therefore a minimum translational freedom with respect to the axis may be required, such as a clearance between a socket and a rotatable element. Especially, referring to the translational freedom of the rotatable elements, the term "selected from the range of 0-20%" and the like does not include the value zero. The clearance may e.g. be in the range of 0.1-1 mm, especially 0.2-0.5 mm.

Essentially, the skin treatment head comprises a plurality of bristles and a plurality of rotatable elements. The plurality of bristles and the plurality of rotatable elements may be associated with the treatment head in a permanent way or in a releasable way. Especially, the rotatable elements may be associated with the treatment head in a releasable way. In such embodiments, the rotatable elements may be replaced when considered desirable, e.g. when treating a different part of the skin, when the treatment head loses functionality (e.g. due to accumulation of material in the rotatable elements preventing the rotatable elements from rotating, due to wear, etc.), or because of hygienic reasons. Hence, in embodiments, the skin treatment head comprises a first part comprising said plurality of bristles and a second part comprising said plurality of rotatable elements, wherein the second part is detachable associated to the first part.

Similar to options for connecting the skin treatment head and the housing, e.g., snap-on snap-off means, or a screw-thread connection may be applied to associate the first part with the second part. Yet, other options may also be possible. In embodiments, the second part and the first parts may be attached to each other and the combination may be associated to the housing and functionally coupled to the actuator. In embodiments, the skin treatment head, especially comprising the second part attached to the first part, is attached (as a whole) to the shaft (comprised by the actuator). In other embodiments, the second part is attached to the shaft and the first part is attached to the shaft (separately) (providing the treatment head).

In yet a further aspect, the invention also provides the skin treatment head per se. Hence, the invention provides amongst others a skin treatment head, especially for use with the body care device as described herein, wherein the skin treatment head ("treatment head") comprises a plurality of bristles defining a virtual edge face ("edge face") circumferentially surrounding the plurality of bristles and defining a virtual top face ("top face") defining a first height (h1) of the bristles relative to a skin treatment head surface of the skin treatment head, wherein the skin treatment head further comprises a plurality of rotatable elements, wherein each rotatable element is configured to rotate when a force in a tangential direction is applied to a rotatable element surface of the rotatable element, wherein the rotatable element surfaces are configured lower than the top face.

Further, the above (and below) described embodiments of the treatment head in relation to the body care device also apply to the treatment head per se. Especially the invention provides the treatment head, wherein the rotatable elements have diameters (d1) and (i) in embodiments the rotatable element surfaces at least partly extend beyond the edge face or (ii) in other embodiments the rotatable element surfaces do not extend beyond the edge face and are configured (within the edge face) (at a side of the edge face facing towards the plurality of bristles) at a (minimal) distance (d2) from the edge face being selected from the range of 0-200%, such as especially 0-100% of the diameters (d1), such as in the range of 0-50% of the diameters.(d1).

In yet another aspect, the invention provides a kit of parts comprising at least one skin treatment head and one or more of at least a further treatment head and a the body care device. Especially, the body care device may comprise a detachable skin treatment head. In embodiments of the kit of parts the device does not comprise a skin treatment head (however the kit of parts comprises at least one skin treatment device). In yet further embodiments, at least one skin treatment head comprises one or more of a first part and a second part, especially at least (i) one or more of a plurality of a first part and a plurality of a second part, and (ii) one or more of a first part and a second part. Such kit especially allows to provide a plurality of different treatment heads when associating (one of) the first part(s) with (one of) the second part(s). In a further embodiment the kit of parts comprises the body care device, with a detachable treatment head, and especially a plurality of treatment heads, such as a plurality of different treatment heads.

In yet a further aspect, the invention also provides a method of treating a part of a skin using the body care device as described herein, the method comprising applying the skin treatment head to the part of the skin, rotating the skin treatment head, and optionally moving the skin treatment head over the part of the skin.

Further specific, but non-limiting embodiments are described below.

The device, for treating the skin, may comprise a housing, a shaft located in the housing having a longitudinal axis and an end for receiving a skin treating head, and a drive means (actuator) configured to cause the shaft to rotate about its longitudinal axis, and optionally also to vibrate in a direction along the longitudinal axis, wherein the drive means comprise a rotational drive unit for rotating the shaft and an vibration generator for vibrating the shaft, the vibration generator is located about the shaft such that the shaft is rotatable relative to the vibration generator, the vibration generator comprises a solenoid and a flux assembly, and the flux assembly is moveable along the shaft relative to the solenoid.

This arrangement provides the advantage that in use, when a skin treatment head is attached to the end of the shaft, the skin treatment head moves substantially perpendicular to the skin which improves the cleaning effect on the skin. Furthermore, the vibration generator is not coupled to the rotational drive unit and so the vibrating movement can be controlled independently to the rotation of the shaft.

Especially, the rotational drive unit and the vibrating generator are configured such that the speed of the rotation and the frequency of the vibration of the shaft can be independently changed of one another in response to a user input.

Advantageously, the user can therefore adjust the frequency and the speed of rotation to their personal preference. Especially, the flux assembly comprises an inner and an outer flux concentrator and a magnet located there between. The arrangement of the flux assembly concentrates the magnetic forces emitted by the magnet.

In embodiments, the outer flux concentrator is made of a base panel having a peripheral side panel, and the inner flux concentrator is received within the peripheral side panel, the magnet is located between the inner flux concentrator and the base panel, and a gap is formed between the inner flux concentrator and the peripheral side panel for receiving the solenoid.

Conveniently, the device further comprises first and second supports holding the shaft, the flux assembly being located about the shaft between the first and second supports and the solenoid being attached to one of the supports.

Advantageously, the flux assembly is retained between the first and second supports such that it cannot accidentally fall off the shaft.

Conveniently, the shaft is held by the first and second supports such that the shaft is rotatable relative to the supports about the longitudinal axis but prevented from moving along the longitudinal axis relative to at least one of the supports.

This arrangement enables the axial movement of the flux assembly to be transferred to the shaft as the flux assembly impacts at least one of the supports The shaft may comprise a circumferential groove in which the one of the supports locate so as to prevent the shaft from moving along the longitudinal axis relative to the support which located in the groove.

Advantageously, as the flux assembly impacts the support located in the groove, the support is moved in an axial direction and transfers the axial movement to the shaft.

One of the supports may be formed with an e-clip that locates in the circumferential groove.

This provides the advantage that the axial movement of the flux assembly is transferred to the support formed with an e-clip and as the e-clip locates in the groove the axial movement is transferred to the shaft.

Especially, one of the supports is formed with a stop which the flux assembly impacts as it vibrates. As the stop takes the impact of the flux assembly, wear of the support formed with the stop is advantageously reduced.

In one embodiment, a spring is located between the first and the second support and the flux assembly so as to reduce the impact as the flux assembly vibrates.

This arrangement advantageously reduces audible noise produced as the flux assembly impacts the first or second support.

The device further comprises a power source powering the drive means. Advantageously, this arrangement enables a single power source to power the drive means reducing size and weight of the device.

In one embodiment, the device further comprises an inverter for changing the current supplied by the power source to alternating current. This causes the polarity of the solenoid to change so that it alternates between being attracted and repelled to the magnet.

Conveniently, the device may comprise a frequency converter for changing the frequency of the alternating current.

Advantageously, the frequency converter is configured to change the frequency in response to a user input such that the strength of the vibrating movement of the shaft and so the tuft can be changed to the personal preference of a user.

The above embodiments describe options to introduce a vibratory movement, when desired. However, also options may be chosen to introduce a vibratory movement parallel to the rotation axis; the invention is not limited to these specific embodiments described above.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
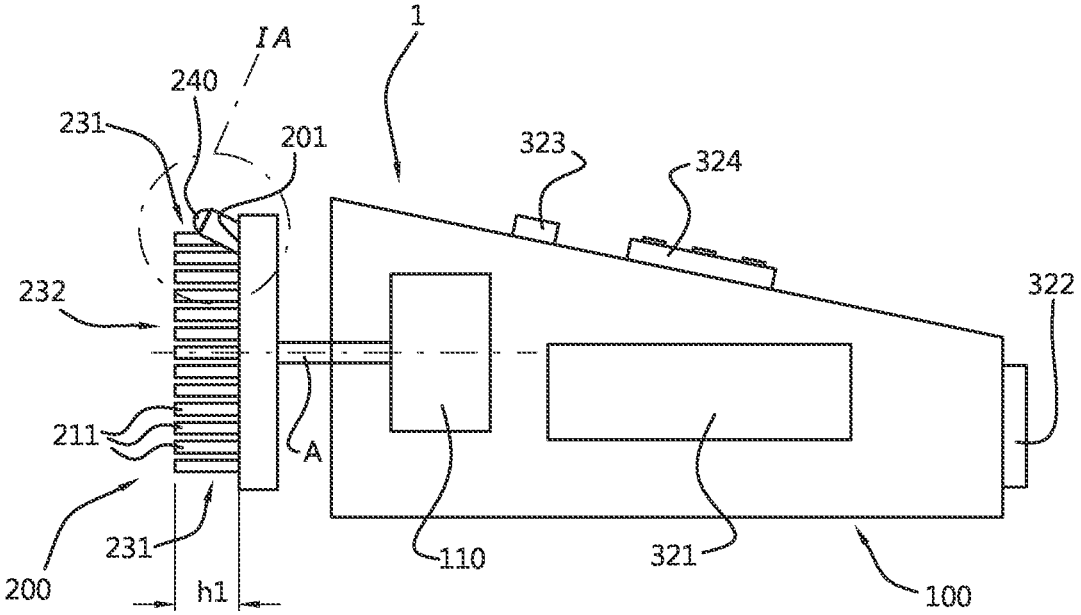
FIGS. 1 and 1*a* schematically depict an embodiment of the body care device.
Figure 1A:
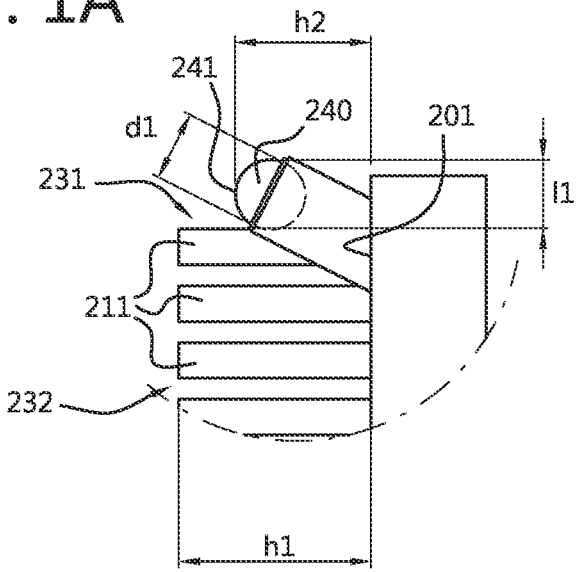

FIGS. 1 and 1*a* schematically depict an embodiment of the device, indicated with reference 1, especially for use in cleansing the skin, such as the skin of a face. Here, the device 1, especially for treating the skin, comprises a housing 100 and a skin treatment head 200 rotatably associated with said housing 100. The housing 100 encloses an actuator 110 configured to rotate said skin treatment head 200 about an axis A, also referred to herein as the head rotation(al) axis A. Herein "rotate" may relate to completely rotate, i.e. allowing multiple consecutive rotations of 360°, also referred herein as a continuous rotation. Rotate may also relate to rotating movements of less than 360°, such as oscillating over a rotation angle (about the head rotation(al) axis A) of e.g. less than 90°. Further, the housing includes in this embodiment a rechargeable battery 321. Yet further, the housing 100 may comprise one or more LED indicators 323 and a user interface 324. Further, the housing may include a means 322 for receiving electrical power for charging the battery, such as a socket known in the art.

In embodiments, the skin treatment head 200 may detachable be associated to the housing (100).

The actuator 110 is especially configured to rotate the skin treatment head 200 about the head rotation axis A. This axis may be parallel, but is not necessary parallel to a body axis of the device.

The skin treatment head 200 comprises a plurality of bristles 211 associated with the treatment head 200. The bristles 211 may be configured in tufts. The bristles 211 may also be configured as single bristles 211. Reference 201 indicates a treatment head surface. The bristles 211 extend from this surface 201. The bristles 211 define a virtual top face 232. In some embodiments, the top face 232 may also comprise a plurality of top faces, see e.g. FIG. 2*b*, schematically depicting two top faces 232 (and 232'). The top face 232 again defines a first height h1 of the bristles 211, see the zoomed in aspects in FIG. 1*a*. Especially, the height h1 of the bristles is relative to the treatment head surface 201. The bristles 211 also define a virtual edge face 231 surrounding, especially circumferentially surrounding, the plurality of bristles 211. Especially, these faces 231, 232 are defined when the bristles are not stressed, such as not pressed against a (skin) surface. The bristles 211 are shown in a non-stressed state.

In general, the treatment head 200 will have a circular cross-section.

The treatment head 200 further comprises a rotatable element 240. The rotatable element 240 is configured to rotate when a force in a tangential direction (with respect to a rotatable element surface 241) is applied to the rotatable element surface 241. When being used, the treatment head 200 may not be optimally placed at a skin surface, and the rotatable element 241 may contact the skin surface. At such a moment a force in a tangentially direction may be applied to the rotatable element surface 241 and the rotatable element 240 may rotate. At the same moment, the person being treated with the body care device 1 may be provided by a tactile feedback because of contact with the rotatable element 240, allowing the person to reposition the treatment head 200 optimally. If a treatment head 200 is positioned optimally, the rotatable element surface 241 is configured not to touch the skin. Therefore, the rotatable element surface 241 especially is configured lower than the (adjacent) top face 232. Especially, the second height h2 of the rotatable element 240 relative to the skin treatment head surface 201 is selected lower than the first height h1 of the adjacent bristles 211. Further, the rotatable element surface 241 may at least partly extend beyond the edge face 231. In other embodiments, the rotatable element 240 does not extend beyond the edge face and is configured within (the part defined by) the edge face 213, see FIG. 2*b*

The skin treatment head 200 may comprises only one rotatable element 240. The skin treatment head 200 may also comprises two rotatable elements 240. Especially, the skin treatment head comprises at least three rotatable elements 240. In embodiments at least one of the rotatable elements 240 comprises a spherical shape having a diameter d1. In further embodiments, at least one of the rotatable elements 240 comprises a cylindrical shape having a diameter (or a width) d1. Especially the rotatable element comprises a spherical shape or a cylindrical shape. In further embodiments, the rotatable element may comprise yet another shape.

Especially, the skin treatment head 200 is configured to be stiff with respect to the rotatable element(s) 240. The rotatable element(s) 240 may have a translational freedom in one or more of a direction parallel and a direction perpendicular to the axis A about which the skin treatment head 200 is configured to at least partly rotate. In embodiments said translational freedom is selected from the range of 0-20% of the diameter d1.

FIG. 1*a* shows a zoomed in aspect of a rotatable element 240 configured partly extending beyond the edge face 231. Herein, reference l1 relates to the length the rotatable elements 240 extend beyond the edge face 231. This first length l1 may especially be selected from the range of 0.5-5 mm. In embodiments, the first length l1 is selected from the range of 5-50% of the diameter d1 of one or more of said rotatable elements 240. In embodiments the rotatable element 240 is configured completely outside of the virtual edge face 231 and the first length l1 is selected to be larger than d1. In such embodiments, l1 is especially at maximum twice the diameter d1.

Figure 2A:
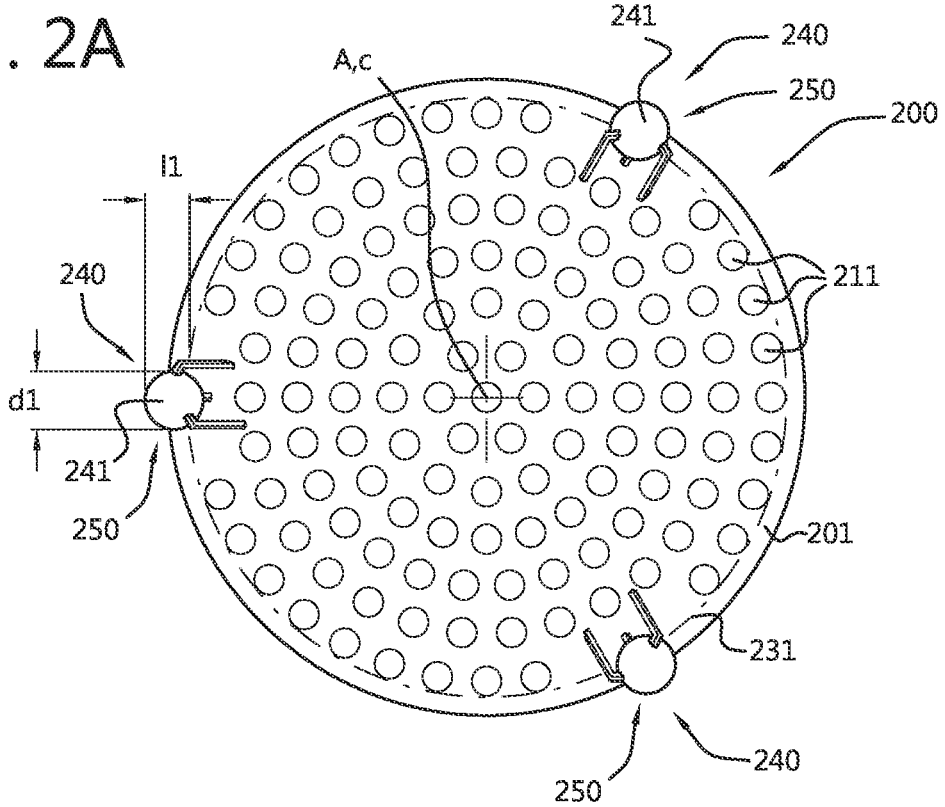
FIGS. 2*a*-2*d* schematically depict some embodiments and variants of the treatment head.
Figure 2B:
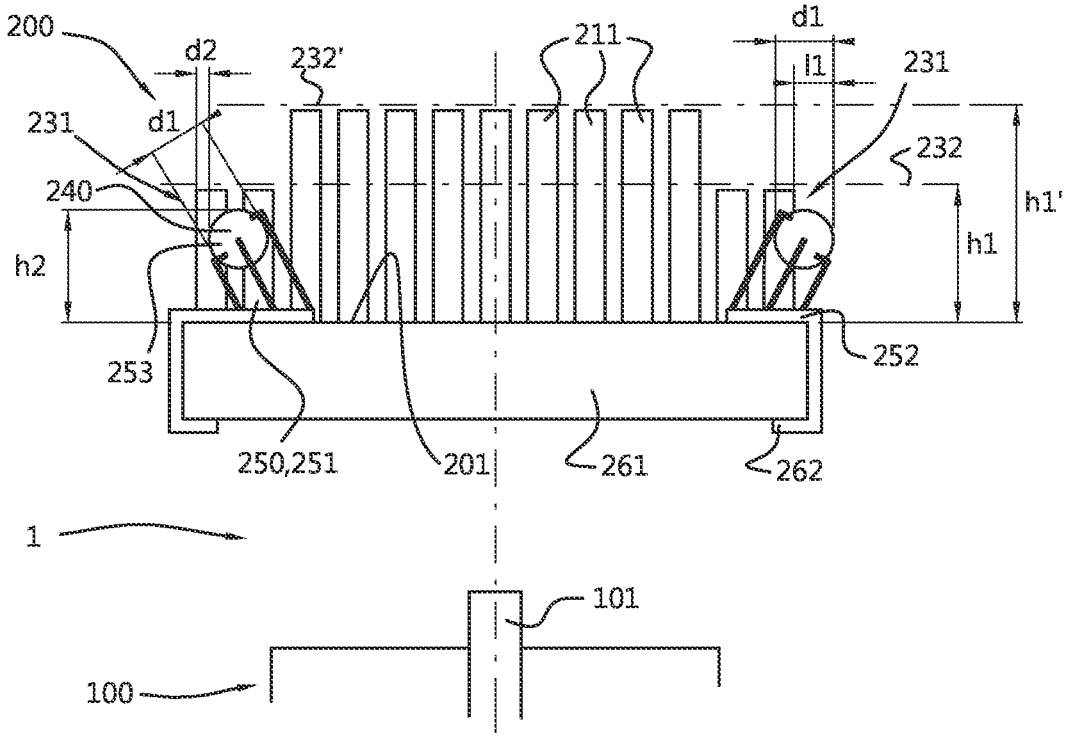

FIG. 2*a* schematically depicts an embodiment of the treatment head 200 in cross-sectional view. The edge face 231 circumferentially surrounds the bristles 211. Especially because of the symmetry, the axis of rotation A intersects the skin treatment head 200 at the center C of the skin treatment head 200. The figure also shows three rotatable elements 240 extending partly, i.e. over the first length l1, from the edge face 231. Especially (the rotatable element units 250 comprising) the rotatable elements 240 are configured in a symmetrical configuration, such as with a Cn rotation axis with n being the number of rotatable elements, meaning that rotation by an angle of 360°/n does not change the object (with respect to the rotatable elements; the plurality of bristles 211 may be arranged differently). This may be explained by the given embodiment. In this embodiment, wherein the number of rotatable elements 240 is three, symmetry is present about the axis of rotation A (about the center C) for a rotation of 120°, 240° and 360°.

FIG. 2*b* schematically depicts aspects of a treatment head 200 wherein the treatment head 200 comprises two top faces 232 indicated by 232 and 232', both defining a first height h1, respectively indicated by h1 and h1'. The figure, further depicts rotatable element units 250 comprising a socket 251, hosting a rotatable element 240. Especially the sockets 251 are configured to host the rotatable elements 240 rotatably.

For instance, the socket 251 may comprise a ball socket 253 as depicted at the left hand side. In other embodiments the socket 251 comprises at least three fingers 252 to rotatably hold a rotatable element 240, schematically depicted at the right hand side.

FIG. 2*b*, further schematically depicts two arrangements of the rotatable elements 240 with respect to the bristles 211. In embodiments, the rotatable elements 240 have a second height h2 relative to the skin treatment head surface 201 in the range of 60-95% of the first height h1 of the adjacent bristles 211. Especially, the second height h2 may be 0.5-3 mm lower than the first height h1 of the bristles 211. As schematically is depicted, when having more than one first height h1, h1', the relevant first height h1 is the first height of the adjacent bristles 211. Hence, for the depicted embodiment, the relevant first height is indicated by h1, not by h1' being more remote from the rotatable element 240. Rotatable elements may be arranged completely outside the virtual edge 231, completely inside the virtual edge 231, or partly extending beyond the edge face 231. The rotatable element 240 schematically depicted at the left hand side of the figure is partly extending beyond the edge face 231. At the left hand side a rotatable element 240 is schematically depicted, wherein the rotatable element surfaces 240 do not extend beyond the edge face and are configured at a minimum distance d2 form the edge face 231. Especially d2 is selected from the range of 0-100% of the diameter d1 of the rotatable element 240.

Figure 2C:
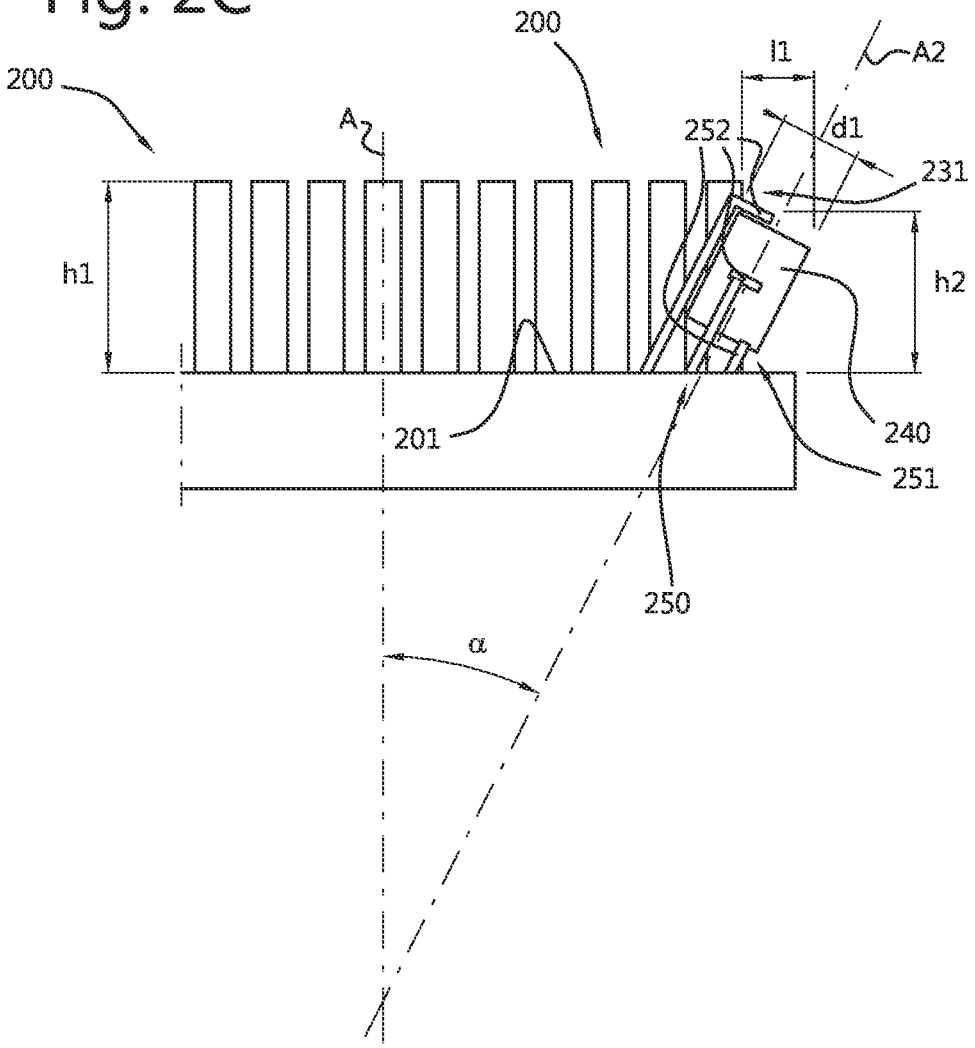

FIG. 2*c* schematically depicts an aspect of an embodiment of a skin treatment head 200 comprising a rotatable element 240 comprising a cylindrical shape. The rotatable element 240 is rotatably hosted by a socket 251 comprising three fingers 252. In the depicted embodiment, the socket 251 comprises three fingers 252, indicated by a short finger 252 at the right hand side, a long finger 252 enclosing the rotatable element 240 at the top side, and a third finger 252 configured in between. The fingers 252 are only depicted schematically and may in embodiments be configured differently. In the depicted embodiment, said third finger 252 is configured in the middle between the two ends of the rotatable element 240. In other embodiments, said third finger 252 may be configured further towards one of the ends of the rotatable element 240. The longer finger 252 enclosing the rotatable element 240 at the top side may in further embodiments be configured at the right hand side of the rotatable element 240 (further remote from the head rotation axis A), especially wherein the short finger 252 is configured more close to the rotation axis A (at the left hand side in the figure). Such a configuration may, e.g., prevent said long finger 252 from touching a skin when some of the bristles are deformed. In yet other embodiments such rotatable element 240 may be hosted by only two fingers 252, such as one finger 252 at each end of the cylindrical shaped rotatable element 240.

The rotatable element 240, especially the cylindrical rotatable element 240 may rotate about a second rotation axis A2. Especially the second rotation axis A2 and the head rotation axis A have a mutual angle $\alpha$. In embodiments, the mutual angle $\alpha$ is selected from the range of 5-135°. In further embodiments, the mutual angle $\alpha$ is selected from the range of 5-90°, such as 5-60°, especially 5-45°. In yet other embodiments, the mutual angle is selected from the range of 30-60°.

Figure 2D:
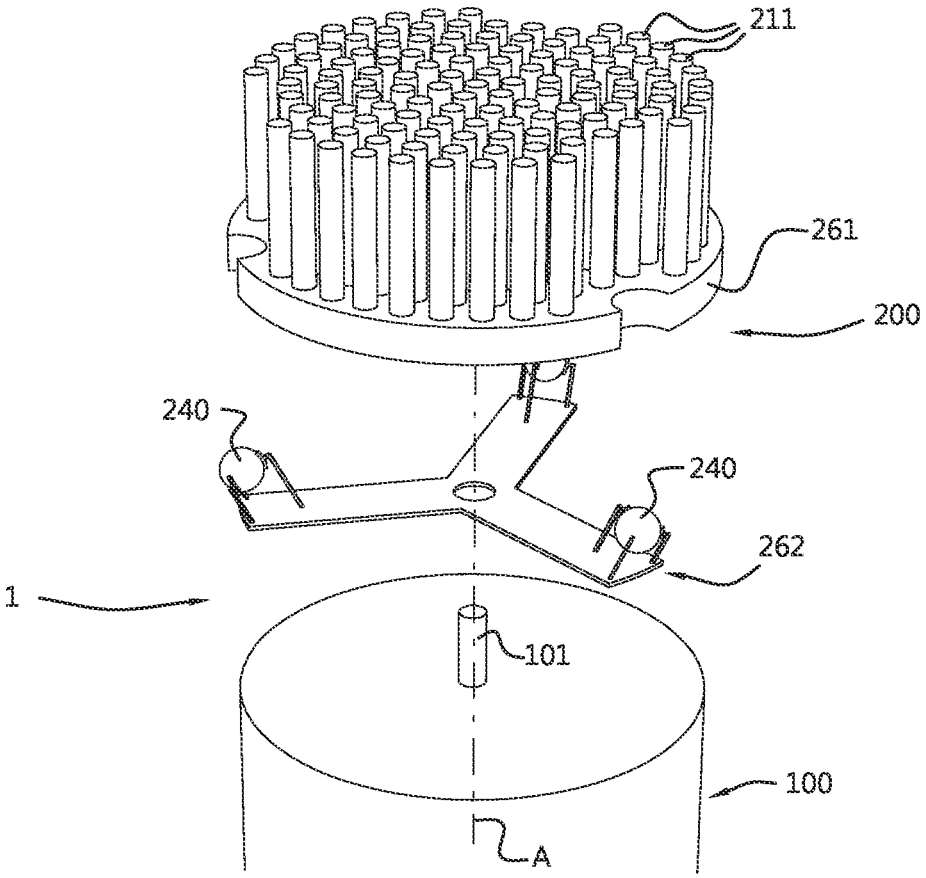

FIGS. 2*b* and 2*d* schematically depict some further aspects of embodiments of the body care device 1 and the skin treatment heat 200. Both figures schematically depicting a first part 261 of the skin treatment head 200 comprising the plurality of bristles 211, and a second part 262 of the skin treatment head 200 comprising the rotatable elements 240. Especially such embodiment allows changing the rotatable elements 240 independently from the bristles 211. In FIG. 2*b* an embodiment is depicted wherein the second part 262 is detachable associated to the first part 261, and wherein the assembly of the first part 261 and second part 261 may be associated with e.g. a shaft 101 of the housing 100. FIG. 2*d* schematically depicts an embodiment wherein the first and second part 261, 262 may separately be associated with the body 100, such as via the shaft 101, especially subsequently providing the skin treatment head 200. In other embodiments the first and the second part 261, 262 are configured to first associate the first part 261 with the body 100 and next to associate the second part 262 with the body 100 and providing the skin treatment head 200.

Embodiments described herein may especially include a centrosymmetric arrangement of the bristles 211 and the rotatable elements 240, see e.g. FIG. 2*a*, but also FIGS. 1, 2*c*, and 2*d* may refer to such embodiments. In FIG. 2*b* radially less distant bristles 211 have a larger height (than radially more distant bristles), whereas in other embodiments radially more distant bristles have a smaller height (than radially less distant bristles). The bristles 211 closest to the edge face 231 are configured radially most distant (from the center C).

With reference to amongst others FIGS. 2*a*-2*d* it is noted that the rotatable element may be within the boundary of the edge face, at this boundary, or even beyond this boundary. Further, as can be seen, the axis of rotation A of (also) the treatment head may be configured perpendicular to at least part of the skin treatment head surface 201.

The term "substantially" herein, such as in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A skin treatment head comprising:

a treatment head surface;

a plurality of bristles extending from the treatment head surface and defining a virtual edge face circumferentially surrounding the plurality of bristles and a virtual top face defining a first height of the bristles; and one or more rotatable elements extending from the treatment head surface and having a second height lower than the first height, such that in order to apply a tangential force to rotate the one or more rotatable elements, the skin treatment head is tilted relative to a skin surface, wherein the one or more rotatable elements are arranged oblique to the treatment head surface.

2. The skin treatment head according to claim 1, wherein each of the one or more rotatable elements has a generally cylindrical shape.

3. The skin treatment head according to claim 1, wherein the one or more rotatable elements have surfaces that extend at least partly beyond the virtual edge face.

4. The skin treatment head according to claim 3, wherein at least one of the one or more rotatable elements has a second height (h2) relative to the treatment head surface, wherein said second height (h2) is in a range of 60-95% of the first height (h1) of the bristles, and wherein the at least one of the one or more rotatable elements extends with a first length (l1) beyond the virtual edge face, and wherein the first length (l1) is selected from a range of 5-50% of a diameter (d1) of the one or more rotatable elements.

5. The skin treatment head according to claim 3, wherein at least one of the one or more rotatable elements have a second height (h2) relative to the treatment head surface, wherein said second height (h2) is in a range of 0.5-3 mm lower than the first height (h1) of the bristles, wherein the at least one of the one or more rotatable elements extends with a first length (l1) beyond the virtual edge face, and wherein the first length (l1) is selected from a range of 0.5-5 mm.

6. The skin treatment head according to claim 1, comprising one or more rotatable element units, wherein each rotatable element unit comprises a socket with at least three fingers for hosting rotatably a rotatable element from the one or more rotatable elements, wherein the hosted rotatable element has a generally spherical shape.

7. The skin treatment head according to claim 1, wherein the one or more rotatable elements have a translational freedom in one or more of (i) a direction parallel and (ii) a direction perpendicular to an axis (A) about which the skin treatment head is configured to at least partly rotate at a range of 0-20% of a diameter (d1) of the one or more rotatable elements.

8. The skin treatment head according to claim 1, wherein the one or more rotatable elements comprise at least three rotatable elements.

9. The skin treatment head according to claim 1, wherein the skin treatment head comprises a first part comprising the plurality of bristles and a second part comprising the one or more rotatable elements, wherein the second part is detachably associated to the first part.

10. The skin treatment head according to claim 1, wherein the treatment head surface is a flat surface or a curved surface.

11. The skin treatment head according to claim 1, wherein the virtual top face is flat or curved based on the first height of the bristles.

12. A skin treatment head comprising:

a treatment head surface;

a plurality of bristles extending from the treatment head surface and defining a virtual edge face circumferentially surrounding the plurality of bristles and a virtual top face defining a first height of the bristles; and one or more rotatable elements extending from the treatment head surface and having a second height lower than the first height, such that in order to apply a tangential force to rotate the one or more rotatable elements, the skin treatment head is tilted relative to a skin surface, wherein the one or more rotatable elements have surfaces that do not extend beyond the virtual edge face.

13. The skin treatment head according to claim 12, wherein the one or more rotatable elements are configured at a distance (d1) from the virtual edge face at a range of 0-100% of a diameter (d2) of the one or more rotatable elements.

14. A body care device for treating a skin, the body care device comprising:

a housing; and a skin treatment head associated with the housing, the skin treatment head comprising:

a treatment head surface;

a plurality of bristles extending from the treatment head surface and defining a virtual edge face circumferentially surrounding the plurality of bristles and a virtual top face defining a first height of the bristles; and one or more rotatable elements extending from the treatment head surface and having a second height lower than the first height, such that in order to apply a tangential force to rotate the one or more rotatable elements, the skin treatment head is tilted relative to a skin surface, wherein the skin treatment head is at least partly rotatable about an axis (A), and wherein the one or more rotatable elements are configured to rotate about a rotation axis (A2) that forms a mutual angle (a) with the axis (A), such that the mutual angle is 5-60°.

15. The body care device according to claim 14, wherein the skin treatment head is fully rotatable about the axis (A).

16. The body care device according to claim 14, wherein the body care device is a handheld device.

17. The body care device according to claim 16, further comprising an actuator configured to rotate the skin treatment head and a power source arranged within the housing.

18. The body care device according to claim 14, wherein the skin treatment head being at least partly rotatable about the axis (A) comprises oscillating over a rotation angle of 5-30°.

19. The body care device according to claim 14, wherein the one or more rotatable elements of the skin treatment head have a translational freedom in at least one of a direction parallel or a direction perpendicular to the axis (A) about which the skin treatment head is at least partly rotatable.

20. The body care device according to claim 19, wherein the translational freedom is a maximum of 20% of a diameter of the one or more rotatable elements.

* * * * *